US008374738B2

(12) United States Patent
Noffsinger et al.

(10) Patent No.: US 8,374,738 B2
(45) **Date of Patent: *Feb. 12, 2013**

(54) METHOD FOR CONTROLLING VEHICLE OPERATION INCORPORATING QUICK CLEARING FUNCTION

(75) Inventors: Joseph Forrest Noffsinger, Lees Summit, MO (US); Ajith Kuttannair Kumar, Erie, PA (US); Glenn Robert Shaffer, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/422,222

(22) Filed: Mar. 16, 2012

(65) Prior Publication Data

US 2012/0179310 A1 Jul. 12, 2012

Related U.S. Application Data

(63) Continuation of application No. 12/099,431, filed on Apr. 8, 2008, now Pat. No. 8,140,203.

(51) Int. Cl.
*G05D 3/00* (2006.01)

(52) U.S. Cl. ..... 701/20; 701/19; 701/300; 246/122 R

(58) Field of Classification Search ..... 701/19, 701/20, 36, 300, 400, 408, 410; 246/122 R
See application file for complete search history.

(56) References Cited

U.S. PATENT DOCUMENTS

| | | | | |
|---|---|---|---|---|
| 4,553,723 | A * | 11/1985 | Nichols et al. | 246/167 R |
| 4,582,280 | A * | 4/1986 | Nichols et al. | 246/182 R |
| 5,340,062 | A * | 8/1994 | Heggestad | 246/5 |
| 5,452,870 | A * | 9/1995 | Heggestad | 246/182 R |
| 5,533,695 | A * | 7/1996 | Heggestad et al. | 246/62 |
| 6,799,097 | B2 * | 9/2004 | Villarreal Antelo et al. | 701/19 |
| 8,140,203 | B2 * | 3/2012 | Noffsinger et al. | 701/20 |
| 2007/0219680 | A1 * | 9/2007 | Kumar et al. | 701/19 |
| 2007/0233364 | A1 * | 10/2007 | Kumar | 701/200 |
| 2010/0262321 | A1 * | 10/2010 | Daum et al. | 701/20 |

* cited by examiner

*Primary Examiner* — Gertrude Arthur Jeanglaude
(74) *Attorney, Agent, or Firm* — GE Global Patent Operation; John A. Kramer

(57) ABSTRACT

A method for operating a train includes: (a) using a processor carried by the train, creating a trip profile which is computed at so as to substantially optimize an operating parameter of the train which depends on multiple operating variables; (b) operating the train along a route at speeds determined by the trip profile; (c) identifying a target location ahead of the train which cannot be cleared in a desired time if the train operates in accordance with the trip profile; and (d) operating the train at a clearing speed substantially faster than determined by the trip profile until the target location is cleared. A computer program product is provided for carrying out the method.

20 Claims, 5 Drawing Sheets

METHOD FOR CONTROLLING VEHICLE OPERATION INCORPORATING QUICK CLEARING FUNCTION

CROSS-REFERENCE TO RELATED APPLICATIONS

This application is a continuation of U.S. application Ser. No. 12/099,431, filed Apr. 8, 2008, now U.S. Pat. No. 8,140, 203, hereby incorporated by reference herein in its entirety.

FIELD

Embodiments of the invention relate to optimizing train operations. Other embodiments relate to controlling a train's operation to improve efficiency while satisfying operational requirements.

BACKGROUND

Trains are complex systems with numerous subsystems, with each subsystem being interdependent on other subsystems. The trains operator is responsible for insuring proper operation of the locomotive and its associated load of passenger or freight cars, including complying with prescribed operating speeds, and assuring that in-train forces remain within acceptable limits. However, the operator cannot usually operate the locomotive so that the fuel consumption is minimized for each trip. For example, factors that must be considered may include emission output, environmental conditions like noise/vibration, a weighted combination of fuel consumption and emissions output, etc. This is difficult to do since, as an example, the size and loading of trains vary, locomotives and their fuel/emissions characteristics are different, and weather and traffic conditions vary.

To address this problem, it is known to provide a train with a computer-implemented system which monitors multiple vehicle parameters and determines the best way to operate the train so as to optimize fuel consumption. Such as system is described in U.S. Patent Application Publication 2007/0225878, entitled "Trip Optimization System and Method for a Train," assigned to the assignee of the present invention.

To save fact, optimization systems such as those described in the '878 Publication normally avoid braking a train as much as practical. For example, when a train is going to slow or stop ahead, or pass through a turnout switch to another track at a reduced speed, the optimization system will begin slowing very early by coasting down to the stop or reduced speed location. Additionally, the optimization system may operate a train at a reduced speed for fuel savings whenever that train's schedule allows.

There are often circumstances where a priority need arises to move out of the way of a second train or trains for operational needs. For example, a train may be changing from one track to a second track through a turnout with an allowable speed of 40 mph. A following or opposing second train cannot pass the turnout location on the first track until the first train has cleared completely through the turnout. In this case, the normal operation of the optimization system might plan to move through the turnout at 10 mph instead of 40 mph for fuel savings, and would interfere with the operational need for high speed.

BRIEF DESCRIPTION

These and other shortcomings of the prior art are addressed by the present invention, which provides a system and method for operating a train whose behavior is otherwise fuel-optimized at a higher speed when operationally required.

According to one aspect of the invention, a method for operating a train includes: (a) using a processor carried by the train, creating a trip profile which is computed so as to substantially optimize an operating parameter of the train which depends on multiple operating variables; (b) operating the train along a route at speeds determined by the trip profile; (c) identifying a target location ahead of the train which cannot be cleared in a desired time if the train operates in accordance with the trip profile; and (d) operating the train at a clearing speed substantially faster than determined by the trip profile until the target location is cleared.

According to another aspect of the invention, a computer program product includes one or more computer readable media having stored thereon a plurality of instructions that, when executed by a processor of a train, causes the processor to: (a) create a trip profile which is computed so as to substantially optimize an operating parameter of the train which depends on multiple operating variables; (b) cause the train to operate the train along a route at speeds determined by the trip profile; (c) identify a target location ahead of the train which cannot be cleared in a desired time if the train operates in accordance with the trip profile; and (d) operate the train at a clearing speed substantially greater than determined by the trip profile until the target location is cleared.

BRIEF DESCRIPTION OF THE DRAWINGS

The invention may be best understood by reference to the following description taken in conjunction with the accompanying drawing figures in which.

DETAILED DESCRIPTION

Figure 1:
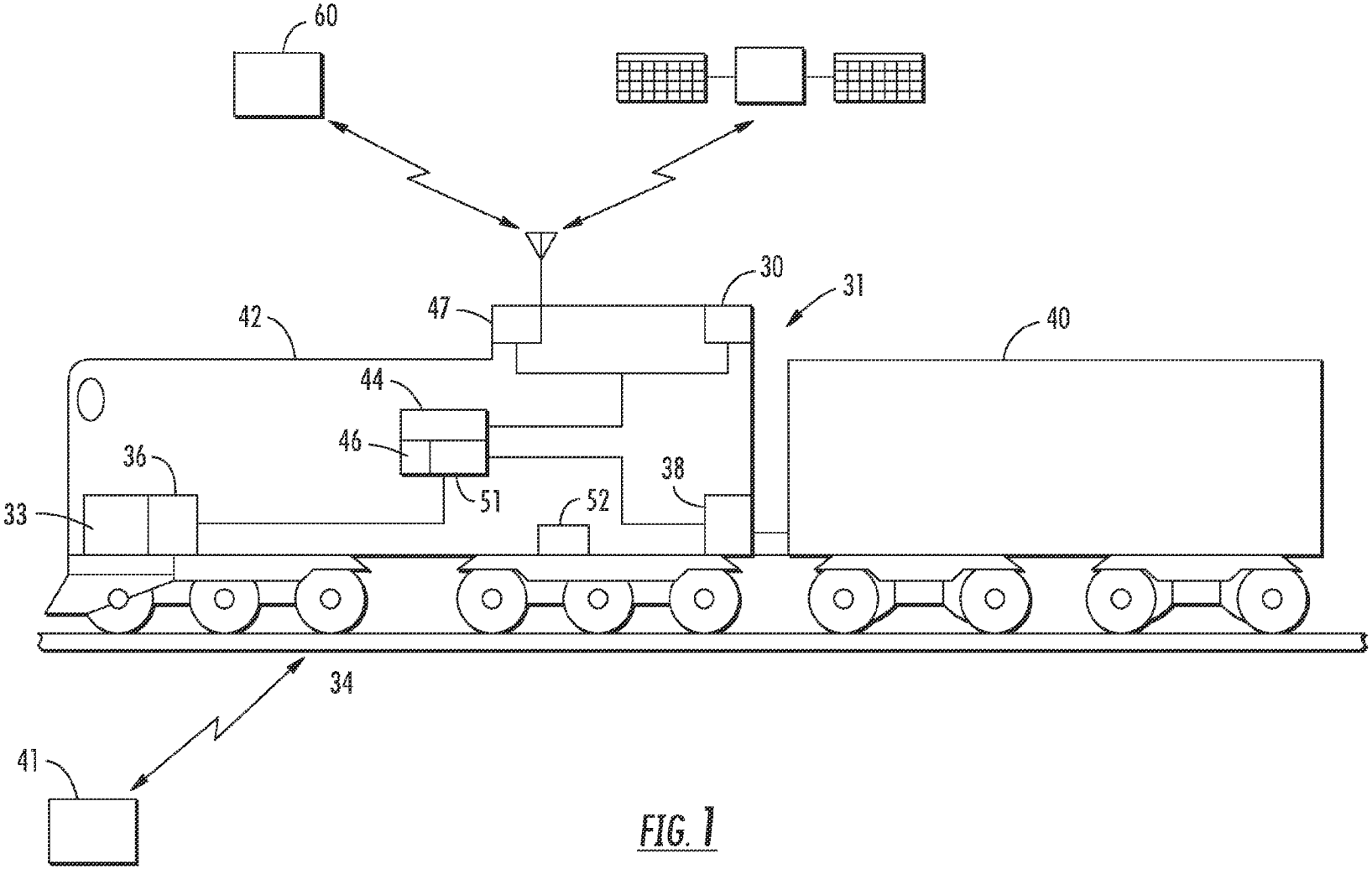
FIG. 1 is a schematic view of a train incorporating apparatus for carrying out an example of the method of the present invention.

Referring to the drawings wherein identical reference numerals denote the same elements throughout the various views, exemplary embodiments of the present invention will be described. The invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary train 31 to which the method of the present invention may be applied. A locator element 30 to determine a location of the train 31 is provided. The locator element 30 can be a GPS sensor, or a system of sensors, that determine a location of the train 31. Examples of such other systems may include, but are not limited to, wayside devices, such as radio frequency automatic equipment identification (RF AEI) tags, dispatch, and/or video determination. Another system may include the tachometer(s) aboard a locomotive and distance calculations from a reference point. A wireless communication system 47 may also be provided to allow for communications between trains and/or with a remote location, such as a dispatcher. Information about travel locations may also be transferred from other trains.

A track characterization element 33 provides information about a track, principally grade and elevation and curvature information. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered.

FIG. 1 further discloses other elements that may be part of the present invention. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver, or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

Figure 2:
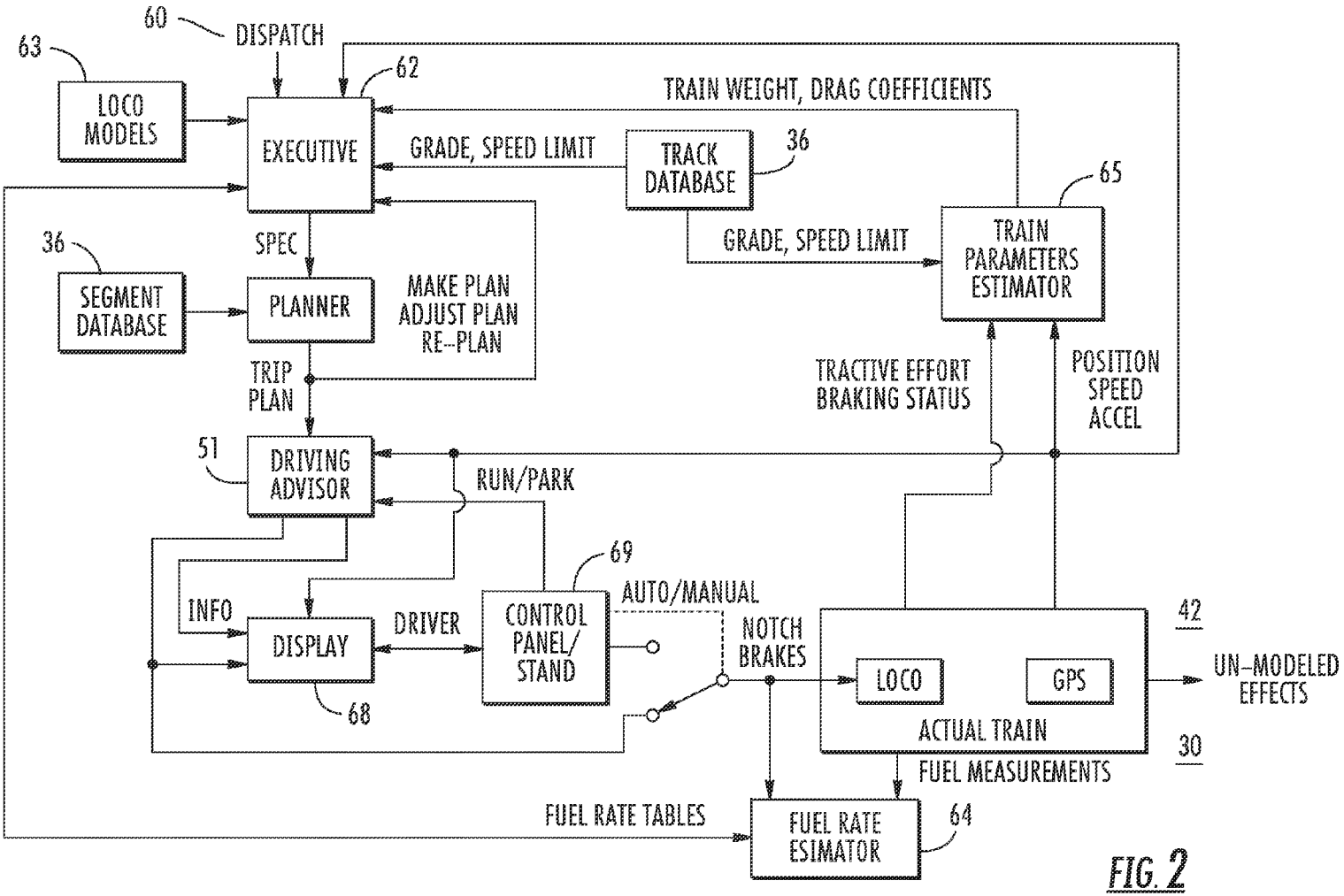
FIG. 2 is a block diagram illustrating the functional components of the present invention.

FIG. 2 depicts a schematic of the functional elements of the present invention. A remote facility, such as a dispatcher 60 can provide information to the train 31. As illustrated, such information is provided to an executive control element 62. Also supplied to the executive control element 62 is locomotive modeling information database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 3. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or, an optimum continuous notch power, in addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in track database and visual signals from the wayside equipment. Based on how the train 31 is functioning, information regarding fuel measurement is supplied to the fuel rate estimator 64. Since direct measurement of fact flows is not typically available in a locomotive consist, all information on fuel consumed so far within a trip and projections into the future following optimal plans is carried out using calibrated physics models such as those used in developing the optimal plans. For example, such predictions may include but are not limited to, the use of measured gross horse-power and known fuel characteristics to derive the cumulative fuel used.

Figure 3:
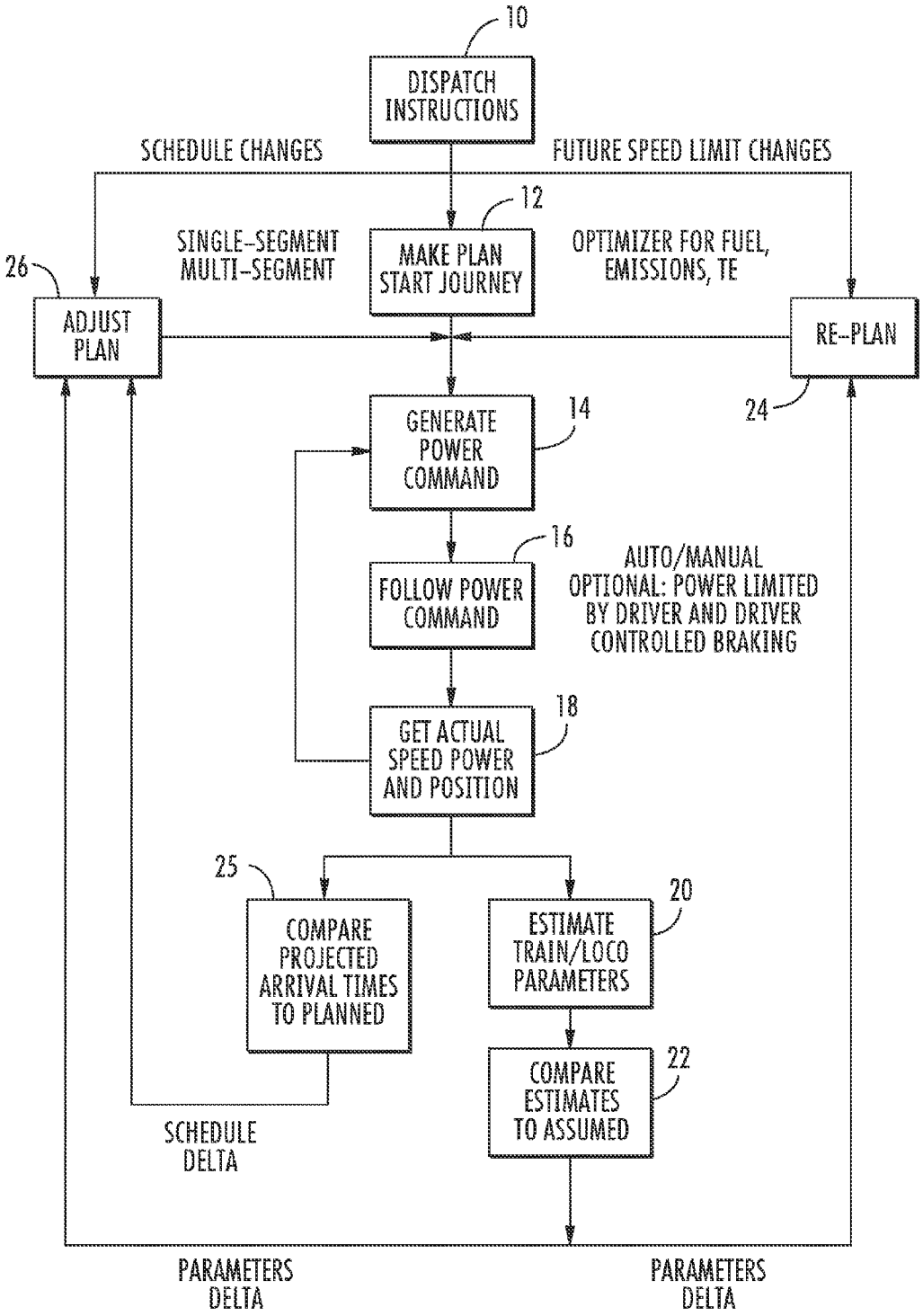
FIG. 3 is a block diagram illustrating a method of train control according to an aspect of the present invention.

The train 31 equipped as described above may be operated according to a trip planning and optimization method described in the '878 Publication noted above. An example of that method is illustrated in FIG. 3. Instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (effective track grade and curvature as function of milepost or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a hard card and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and the operating rules associated with each of the signals. For example, some signals have a single light (on/off), some signals have a single lens with multiple colors, and some signals have multiple lights and colors. These signals can indicate the track is clear and the train may proceed at max allowable speed. They can also indicate a reduced speed or stop is required. This reduced speed may need to be achieved immediately, or at a certain location (e.g., prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art the profiles provides power settings for the train, either at the train level, consist level and/or individual train level. Power comprises braking power, motoring power, and airbrake power. In another preferred embodiment, instead of operating at the traditional discrete notch power settings, the present invention is able to select a continuous power setting determined as optimal for the profile selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute anew one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time. It is also possible to setup, for example, a goal to minimize the total travel time without constraints on total emissions or fuel use where such relaxation of constraints would be permitted or required for the mission.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

Where x is the position of the train, v its velocity and t is time (in miles, miles per hour and minutes or hours as appropriate and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup and terrain on which the train is located, R is the net speed dependent drag of the locomotive consist and train combination. The initial and final speeds can also be specified, but without loss of generality are taken to be zero here (train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time.

As will be discussed in more detail below, it is also possible to setup, for example, a goal to minimize the total travel time without constraints on total emissions or fuel use where such relaxation of constraints would be permitted or required for the mission. All these performance measures can be expressed as a linear combination of any of the following:

$$\min_{u(t)} \int_0^{T_f} F(u(t))\,dt - \text{Minimize total fuel consumption}$$

$$\min_{u(t)} T_f - \text{Minimize Travel Time}$$

$$\min_{u_i} \sum_{i=2}^{n_d} (u_i - u_{i-1})^2 - \text{Minimize notch jockeying (piecewise constant input)}$$

$$\min_{u(t)} \int_0^{T_f} \left(\frac{du}{dt}\right)^2 dt - \text{Minimize notch jockeying (continuous input)}$$

A commonly used and representative objective function is thus $$\min_{u(t)} \alpha_1 \int_0^{T_f} F(u(t))\,dt + \alpha_3 T_f + \alpha_2 \int_0^{T_f} \left(\frac{du}{dt}\right)^2 dt (OP)$$

The coefficients of the linear combination will depend on the importance (weight) given for each of the terms. Note that in equation (OP), u(t) is the optimizing variable which is the continuous notch position. If discrete notch is required, e.g. for older locomotives, the solution to equation (OP) would be discretized, which may result in less fuel saving. Finding a minimum time solution ($\alpha_1$ and $\alpha_2$ set to zero) is used to find a lower bound on, the preferred embodiment is to solve the equation (OP) for various values of $T_f$ with $\alpha_3$ set to zero. For those familiar with solutions to such optimal problems, it may be necessary to adjoin constraints, e.g. the speed limits along the path:

$$0 \leqq v \leqq SL(x)$$

Or when using minimum time as the objective, that an end point constraint must hold, e.g. total fuel consumed must be less than what is in the tank, e.g. via:

$$0 < \int_0^{T_f} F(u(t))\,dt \leq W_F$$

Where $W_F$ is the fuel remaining in the tank at $T_f$. Those skilled in the art will readily recognize that equation (OP) can be in other forms as well and that what is presented above is an exemplary equation for use in the present invention.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example in an exemplary embodiment, suppose a train is traveling a 172-mile stretch of track in the southwest United States. Utilizing the present invention, an exemplary 7.6% saving in fuel used may be realized when comparing a trip determined and followed using the present invention versus an actual driver throttle/speed history where the trip was determined by an operator. The improved savings is realized because the optimization realized by using the present invention produces a driving strategy with both less drag loss and little or no braking loss compared to the trip plan of the operator. To make the optimization described above computationally tractable, a simplified mathematical model of the train may be employed.

Referring back to FIG. 3, once the trip is started 12, power commands are generated 14 to put the plan in motion. Depending on the operational set-up of the present invention, one command is for the locomotive to follow the optimized power command 16 so as to achieve the optimal speed. The present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used optimization may differ significantly from the actual train. This can occur for many reasons, including but not limited to, extra cargo pickups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons trip may be re-planned include directives from a remote location, such as dispatch and/or the operator requesting a change in objectives to be consistent with more global movement planning objectives. More global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. The present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains.

Many events in daily operations can lead to a need to generate or modify a currently executing plan, where it desired to keep the same trip objectives, for when a train is not on schedule for planned meet or pass with another train and it needs to make up time. Using the actual speed, power and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically following a railroad company's desire for how such departures from plan should be handled or manually propose alternatives for the on-board operator and dispatcher to jointly decide the best way to get back on plan. Whenever a plan is updated but where the original objectives, such as but not limited to arrival time remain the same, additional changes may be factored in concurrently, e.g. new future speed limit changes, which could affect the feasibility of ever recovering the original plan. In such instances if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such a train operating limits, are exceeded. For example, if the current plan execution is running late by more than a specified threshold, such as thirty minutes, the present invention can re-plan the trip to accommodate the delay at expense of increased fuel as described above or to alert the operator and dispatcher how much of the time can be made up at all (i.e. what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such in the assumed train load. That is, if the change reflects impairment in the locomotive performance for the current trip, these may be factored into the models and/or equations used in the optimization.

Changes in plan Objectives can also arise from a need to coordinate events where the plan for one train compromises the ability of another train to meet objectives and arbitration at a different level, e.g. the dispatch office is required. For example, the coordination of meets and passes may be further optimized through train-to-train communications. Thus, as an example, if a train knows that it is behind in reaching a location for a meet and/or pass, communications from the other train can notify the late train (and/or dispatch). The operator can then enter information pertaining to being late into the present invention wherein the present invention will recalculate the train's trip plan. The present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could depend either from schedule or fuel saving benefits, depending on the situation.

Once a trip plan is created as discussed above, a trajectory of speed and power versus distance is used to reach a destination with minimum fuel and/or emissions at the required trip time. There are several ways in which to execute the trip plan. As provided below in more detail, in one exemplary embodiment, a coaching mode the present invention displays information to the operator for the operator to follow to achieve the required power and speed determined according to the optimal trip plan. In this mode, the operating information is suggested operating conditions that the operator should use. In another exemplary embodiment, acceleration and maintaining a constant speed are performed by the present invention. However, when the train 31 must be slowed, the operator is responsible for applying a braking system 52. In another exemplary embodiment, the present invention commands power and braking as required to follow the desired speed-distance path.

During the trip, regardless of whether the train 31 is operated in accordance with a plan determined prior to departure, the train 31 may encounter one or more locations where increased speed is required to quickly pass or "clear" certain locations, in contravention to the trip plan. The operation of the train 31 at higher-than-planned speed is referred to herein as a "quick clear" operation, process, or mode.

Figure 4:
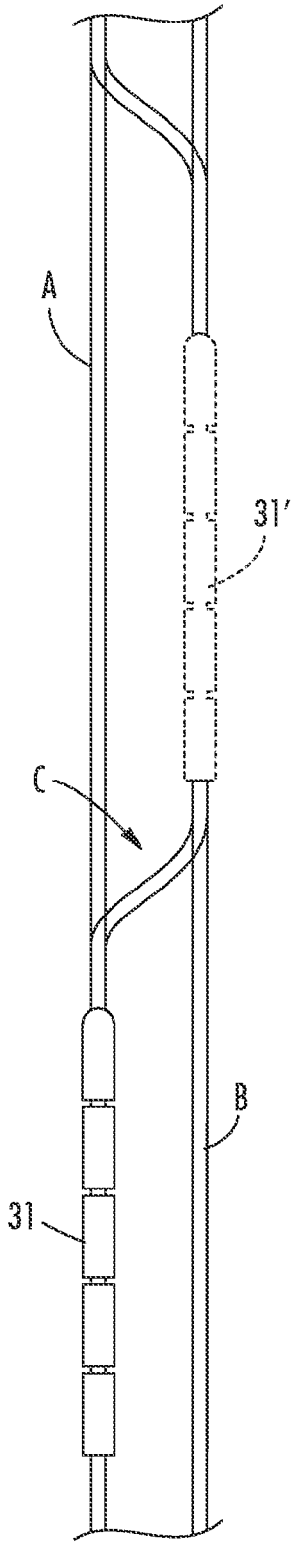
FIG. 4 is a schematic top view of a train operating on a section of track having a turnout switch.

For example, as shown in FIG. 4, the train 31 may be operating on a first track "A", and preparing to move to a second parallel track "B" through a turnout "C". A following or opposing second train (not shown) cannot pass the turnout location on track A until the first train 31 has cleared completely through the turnout C, to the position 31' shown in dashed lines. The turnout position C is referred to herein as "target location". Based on the condition of the train 31 and track, the railroad's operating rules, etc., the turnout C may have a relatively high allowable speed, for example 40 mph. However, the trip plan might ordinarily move the train 31 through the turnout at 10 mph instead of 40 mph to save fuel. In contrast, a quick clearing function identifies the situation as requiring a higher speed and expedites the first train 31 into track B.

Figure 5:
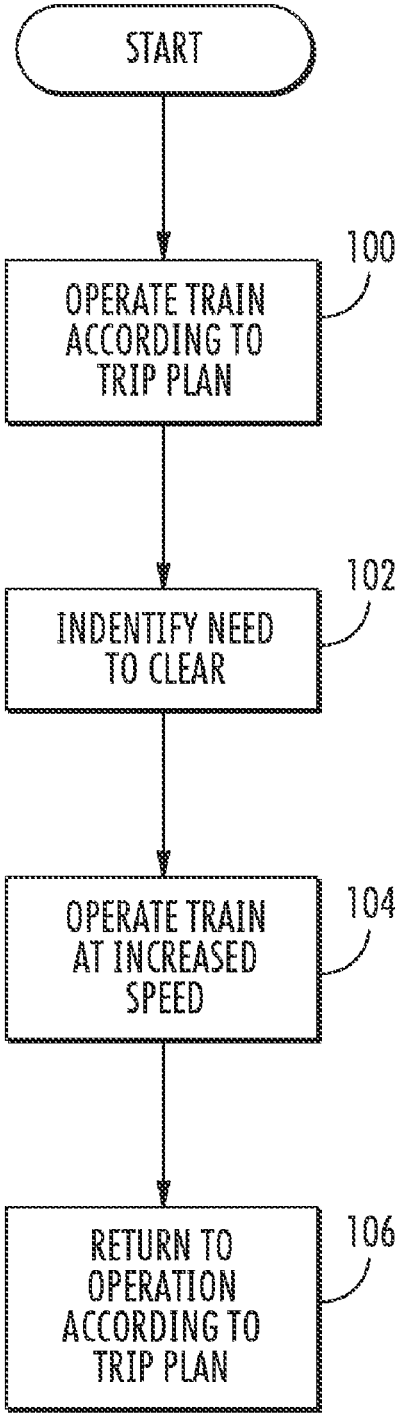
FIG. 5 is a flow chart illustrating a method of implementing a quick clearing function according to an aspect of the invention.

FIG. 5 illustrates the basic method for carrying out a quick clearing: function. Initially, the train 31 is operated according to the trip plan as described above, typically in a fuel-optimized manner (block 100). A quick clearance is invoked at block 102. Identification of the need for a quick clearance may take place in a number of ways. For example, if a railroad has a control center movement planner or pacing system capable of identifying the situation or location (e.g. dispatcher 60), it communicates revised plan times to the train 31, and the algorithm 46 in the processor 44 replans to the revised waypoints, with the target of minimizing travel time, and then accelerates movement. In this case the quick clearance function resides in part in the central planner system.

Another method of identifying a need for quick clearing operation is through manual input from the operator of the train 31. For example, the operator would touch a button on the control panel 69 causing the system to switch to a quick clearance mode.

Another method of invoking a quick clear function is possible when the operator is able to identify the situation in advance. The operator inserts a special waypoint with desired times for front and rear of the train 31. The processor 44 then executes the modified plan. The advantage of this method of invocation is that the further ahead the driver can modify the plan, the more time the processor 44 has to execute the plan and may balance the immediate need for increased speed with fuel savings.

The train 31 is then operated at increased speed (block 104). To achieve maximum benefit of the quick clear operation, the train 31 may be operated at the maximum speed allowed on the route. Optionally, when the quick clear operation is invoked, either manually or by a central movement planner, the train 31 may immediately be accelerated to the maximum allowable speed for the section of track that it is operating on, regardless of whether replanning is complete or not. This minimizes delay.

When the train 31 has cleared the location requiring high speed, the quick clearance function or mode is canceled. If the train 31 is to continue on, it is returned to normal speed operation in accordance with the computed trip plan (see block 106). In some situations, the quick clearing operation could terminate in a full stop. In other words, the quick clearing function would result in the train 31 maintaining a greater speed and then stopping relatively quickly, rather than "coasting" to a stop at a lower deceleration, as would be the case if the trip optimizing system were used.

If the quick clear mode has been manually invoked, it may be canceled by the driver touching the button again, toggling the system to normal operation. Optionally, the trip optimizing system may automatically restore normal operation after determining, that the rear of a train 31 has cleared a target location or otherwise identified qualifying feature of the railway infrastructure. Some examples of qualifying features include turnouts, highway crossings at grade and railroad crossings at grade. If the quick clear mode has been invoked by a central planner or by driver input of a waypoint, it is canceled when the train 31 has cleared those waypoints.

The position of the rear of the train 31 may be inferred from the location of the front of the train and the overall train length, or it may be provided directly by an end-of-train unit of a known type (not shown) which reports the position of the rear of the train to the head of the train 31 or to an external interrogating device.

An embodiment relates to a method for operating a vehicle. The method comprises, using a processor carried by the vehicle, creating a trip profile that comprises at least one of speed settings or power settings the vehicle is to follow expressed as a function of distance and/or time along a route of the vehicle. The method further comprises operating the vehicle along the route at speeds based on the trip profile. The method further comprises identifying a target location ahead of the vehicle which cannot be cleared in a desired time if the vehicle operates in accordance with the trip profile. The method further comprises operating the vehicle at a clearing speed substantially faster than based on the trip profile until the target location is cleared.

In another embodiment, the method further comprises returning the vehicle to operation in accordance with the trip profile when the target location has been passed.

In another embodiment, the trip profile is created so as to substantially optimize one or more operating parameters of the vehicle, the operating parameters comprising one or more of fuel consumption, emissions, trip time, or crew operating time of the vehicle.

In another embodiment, the target location is identified by a planning center external to the vehicle and is communicated to the processor.

In another embodiment, the target location is input to the processor from on board the vehicle.

In another embodiment, the vehicle is accelerated to the clearing speed in direct response to a control input from on board the vehicle.

In another embodiment, the processor determines when the target location has been passed by the vehicle, and automatically returns the vehicle to operation in accordance with the trip profile when the target location is passed.

In another embodiment, subsequent to identifying the target location, the processor creates a new trip profile which is computed to minimize travel time to the target location.

In another embodiment, the vehicle is immediately accelerated to the clearing speed while the processor is creating the new trip profile.

Another embodiment relates to a method for operating a vehicle. The method comprises operating the vehicle along a route at speeds based on a trip profile, wherein the trip profile is created by a processor and comprises at least one of speed settings or power settings the vehicle is to follow expressed as a function of distance and/or time along the route. The method further comprises identifying a target location ahead of the vehicle along the route which cannot be cleared in a desired time if the vehicle operates in accordance with the trip profile, and operating the vehicle at a clearing speed substantially faster than based on the trip profile until the target location is cleared.

In another embodiment of the method, identifying the target location comprises receiving, from off-board the vehicle, information of the target location.

Another embodiment relate to a computer program product comprising one or more computer readable media having stored thereon a plurality of instructions that are configured, when executed by a processor of a vehicle, to cause the processor to output signals relating to operating the vehicle along a route at speeds based on a trip profile, wherein the trip profile comprises at least one of speed settings or power settings the vehicle is to follow expressed as a function of distance and/or time along the route. The instructions are further configured, when executed by the processor, to cause the processor to identify a target location ahead of the vehicle which cannot be cleared in a desired time if the vehicle operates in accordance with the trip profile, and to output signals relating to operating the vehicle at a clearing speed substantially greater than based on the trip profile until the target location is cleared.

In another embodiment of the computer program product, the trip profile is configured so as to substantially optimize one or more operating parameters of the vehicle, the operating parameters comprising one or more of fuel consumption, emissions, trip time, or crew operating time of the vehicle.

In another embodiment of the computer program product, the instructions are further configured to cause the processor to output signals relating to returning the vehicle to operation in accordance with the trip profile when the target location has been passed.

In another embodiment of the computer program product, the instructions are further configured to cause the processor to identify the target location by receiving information of the target location from a planning center external to the vehicle.

In another embodiment of the computer program product, the instructions are further configured to cause the processor to identify the target location by receiving information of the target location input to the processor from on board the vehicle.

In another embodiment of the computer program product, the instructions are further configured to cause the processor to automatically operate the vehicle at the speeds based on the trip profile and to automatically operate the vehicle at the clearing speed.

In another embodiment of the computer program product, the instructions are further configured to cause the processor, subsequent to identifying the target location, to create a new trip profile that minimizes travel time to the target location.

In another embodiment of the computer program product, the instructions are further configured to cause the processor to determine when the target location has been passed by the vehicle, and to automatically return the vehicle to operation in accordance with the trip profile when the target location is passed.

The foregoing has described a system and method for quickly moving a train through a specified location. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A method for operating a vehicle, comprising:

using a processor carried by the vehicle, creating a trip profile that comprises at least one of speed settings or power settings the vehicle is to follow expressed as a function of distance and/or time along a route of the vehicle;

operating the vehicle along the route at speeds based on the trip profile;

identifying a target location ahead of the vehicle which cannot be cleared in a desired time if the vehicle operates in accordance with the trip profile; and operating the vehicle at a clearing speed substantially faster than based on the trip profile until the target location is cleared.

2. The method of claim 1 further comprising returning the vehicle to operation in accordance with the trip profile when the target location has been passed.

3. The method of claim 1 wherein the trip profile is created so as to substantially optimize one or more operating parameters of the vehicle, the operating parameters comprising one or more of fuel consumption, emissions, trip time, or crew operating time of the vehicle.

4. The method of claim 1 wherein the target location is identified by a planning center external to the vehicle and is communicated to the processor.

5. The method of claim 1 wherein the target location is input to the processor from on board the vehicle.

6. The method of claim 1 wherein the vehicle is accelerated to the clearing speed in direct response to a control input from on board the vehicle.

7. The method of claim 6 wherein the processor:

determines when the target location has been passed by the vehicle; and automatically returns the vehicle to operation in accordance with the trip profile when the target location is passed.

8. The method of claim 1 wherein subsequent to identifying the target location, the processor creates a new trip profile which is computed to minimize travel time to the target location.

9. The method of claim 8 wherein the vehicle is immediately accelerated to the clearing speed while the processor is creating the new trip profile.

10. The method of claim 1 wherein the processor:

determines when the target location has been passed by the vehicle; and automatically returns the vehicle to operation in accordance with the trip profile when the target location is passed.

11. A method for operating a vehicle, comprising:

operating the vehicle along a route at speeds based on a trip profile, wherein the trip profile is created by a processor and comprises at least one of speed settings or power settings the vehicle is to follow expressed as a function of distance and/or time along the route;

identifying a target location ahead of the vehicle along the route which cannot be cleared in a desired time if the vehicle operates in accordance with the trip profile; and operating the vehicle at a clearing speed substantially faster than based on the trip profile until the target location is cleared.

12. The method of claim 11 wherein identifying the target location comprises receiving, from off-board the vehicle, information of the target location.

13. A computer program product comprising one or more computer readable media having stored thereon a plurality of instructions that are configured, when executed by a processor of a vehicle, to cause the processor to:

output signals relating to operating the vehicle along a route at speeds based on a trip profile, wherein the trip profile comprises at least one of speed settings or power settings the vehicle is to follow expressed as a function of distance and/or time along the route;

identify a target location ahead of the vehicle which cannot be cleared in a desired time if the vehicle operates in accordance with the trip profile; and output signals relating to operating the vehicle at a clearing speed substantially greater than based on the trip profile until the target location is cleared.

14. The computer program product of claim 13 wherein the trip profile is configured so as to substantially optimize one or more operating parameters of the vehicle, the operating parameters comprising one or more of fuel consumption, emissions, trip time, or crew operating time of the vehicle.

15. The computer program product of claim 13 wherein the instructions are further configured to cause the processor to output signals relating to returning the vehicle to operation in accordance with the trip profile when the target location has been passed.

16. The computer program product of claim 13 wherein the instructions are further configured to cause the processor to identify the target location by receiving information of the target location from a planning center external to the vehicle.

17. The computer program product of claim 13 wherein the instructions are further configured to cause the processor to identify the target location by receiving information of the target location input to the processor from on board the vehicle.

18. The computer program product of claim 13 wherein the instructions are further configured to cause the processor to automatically operate the vehicle at the speeds based on the trip profile and to automatically operate the vehicle at the clearing speed.

19. The computer program product of claim 13 wherein the instructions are further configured to cause the processor, subsequent to identifying the target location, to create a new trip profile that minimizes travel time to the target location.

20. The computer program product of claim 13 wherein the instructions are further configured to cause the processor to:

determine when the target location has been passed by the vehicle; and automatically return the vehicle to operation in accordance with the trip profile when the target location is passed.

* * * * *